US005098739A

United States Patent [19]

Sarda

[11] Patent Number: 5,098,739

[45] Date of Patent: Mar. 24, 1992

[54] THERMOGRAPHIC RELIEF PRINTING METHOD

[76] Inventor: Jean L. Sarda, 48, Avenue Clandi Vellifaux, Paris, France

[21] Appl. No.: 332,542

[22] Filed: Apr. 3, 1989

[30] Foreign Application Priority Data

Apr. 18, 1988 [FR] France ..... 88 05097

[51] Int. Cl.[5] ..... B05D 5/00; B05D 1/36

[52] U.S. Cl. ..... 427/197; 427/201; 427/202

[58] Field of Search ..... 118/310, 312; 427/201, 427/197, 202, 198, 195

[56] References Cited

U.S. PATENT DOCUMENTS

| | | | |
|---|---|---|---|
| 1,531,613 | 3/1925 | Hommel | 427/193 |
| 2,689,801 | 9/1954 | D'Alelio | 427/197 |
| 2,757,635 | 8/1956 | Lipsius | 118/312 |
| 2,821,163 | 1/1958 | Walton | 118/312 X |
| 3,682,738 | 8/1972 | Smith | 427/197 X |

*Primary Examiner*—Evan Lawrence
*Attorney, Agent, or Firm*—Charles D. Gunter, Jr.

[57] ABSTRACT

A thermographic relief printing method is shown for printing a substrate at a printing station. The substrate is sprinkled with a thermographic powder at successive stations with each application station being provided with an applicator for applying a powder a predetermined grain size. The grain sizes are selected to achieve the maximum packing density and the powders are formed with substantially microspheric form of a specified diameter. The diameter of the powder grains at the first application station is greater than the diameter of the powder grains at the next successive application station. The substrate is passed to an oven in which the powder is fused to the printed areas of the substrate.

3 Claims, 7 Drawing Sheets

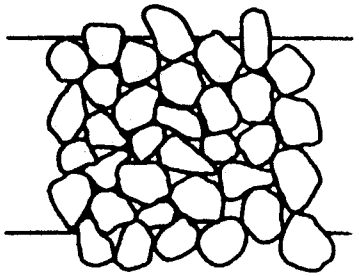
Fig. 5A
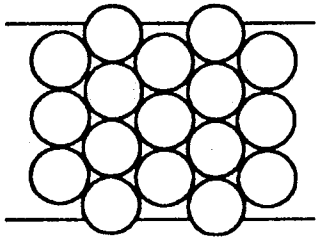
Fig. 5B
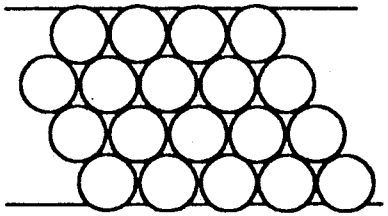
Fig. 5C
Fig. 5D
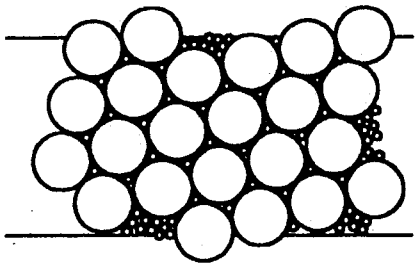
Fig. 5E
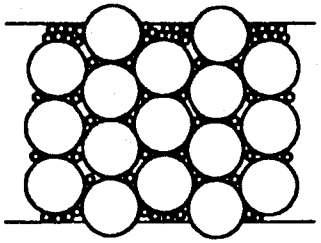
Fig. 5F
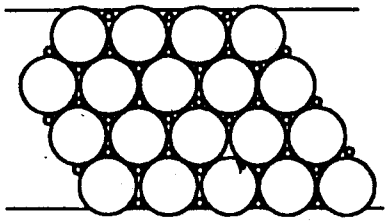
Fig. 5G
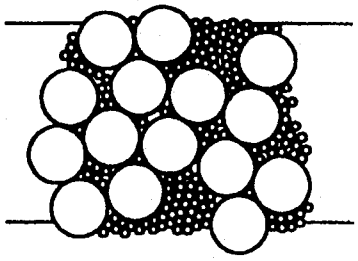
Fig. 5H

THERMOGRAPHIC RELIEF PRINTING METHOD

BACKGROUND OF THE INVENTION

1. Field of the Invention

The present invention relates to the field of thermographic relief printing and, more precisely, with the powders used in this procedure.

2. Description of the Prior Art

Thermographics is an established procedure permitting relief printing imitating copper plate printing or stamping from any type of printing process, whether offset or other. The transformation into relief can be achieved, for example, by sprinkling a freshly printed sheet of paper with a powder which has the characteristic of melting under the effect of heat and of forming, after fusion, a film in relief. On the printed parts, the wet ink retains the powder, the excess being continually sucked up and recycled. The printed and powdered sheet then passes through a tunnel oven where it is heated to fuse the powder. At the exit, a blast of cold air cools the sheet and instantaneously sets the viscous film in relief so as to prevent successive sheets from sticking together. Transparent powders can be used, with shiny or matt finishes to thereby preserve the colors of the original printing. If desired, pigmented powders can be used to create a relief corresponding to their pigment.

The granule size of the powder used determines the thickness of the film in relief. The thicker the powder used, the greater the relief. This type of relief printing is used for a variety of different applications such as: commercial work (visiting cards, business cards, letterheads, envelopes, invitation cards, advertising material), labelling on rolls, microprocessing (computer listings) etc.

Over the last eighty years the described procedure has evolved considerably. In the beginning, the powdering of the printed sheets was carried out by hand, then progressively the first machines for transforming into relief became automatic. These machines were still very bulky and were generally reserved for printers specialized in this technique. In the last twenty years the appearance of a new generation of very compact and rapid automatic machines, for use by a large clientel of traditional printers, has meant real industrial development in this procedure.

Unfortunately, these compact machines have also had the length of their tunnel ovens decreased. The amount of time taken for printed matter to pass through these tunnel ovens where the transformation into relief is carried out is, depending on the length of these ovens and the production rate, extremely short, between a half and three seconds. Parallel to this development, offset printing presses to which thermographic machines can be linked automatically, have had their production rates increased by between 1 and 5 times and some of them, specialized in the printing of envelopes, reach a production of 60,000 per hour.

The thermographic powders in use at present throughout the world are mainly of American and English origin, with the exception of a German product which has recently come on the market. The general characteristics of the commercially available powders are more or less the same and only one type of product is proposed to the user by each manufacturer to cover different printing needs and end uses.

Obliged to use these products and in order to bridge the gap created by the performance of the machines and the lack of progress in powders, the equipment designers have been obliged to use very short tunnel ovens which have been provided with increased heating potentials. The temperature reached in the center of these tunnel ovens is typically between 450° and 600° C.

Serious inadequacies and major inconveniences result, of which the principal are the following:

1. The mediocre quality of the film, with craters in the solid parts and a 'hammered' surface appearance like an orange skin.

2. A yellowing and partial destruction of the supporting fiber which has been violently dehydrated and subjected to considerable thermal shock.

3. The impossibility of machines equipped with compact ovens of dealing with large size or heavy-weight card as well as more light-weight printed matter which does not stand up to a violent thermal shock.

4. A considerable shrinking in the size of the printed matter resulting from sudden dehydration and partial alteration of the fiber. This uneven shrinking makes it practically impossible to print material intended for collecting into sheaves. This same fault, among others, occurs when printing on sheets or card when flat which are then folded into box shape. The folding and remolding of the form become very difficult.

5. High energy costs making the production cost of the transforming into relief procedure too expensive. In air conditioned premises, the supplementary energy required to compensate for the rise in temperature due to the release of hot air from the tunnel ovens doubles the total energy requirement when transforming printed matter into relief.

6. The power required is too great making it impossible for many small print works to install these machines because of insufficient power being available.

7. Immediate thermal resistance of the film is insufficient to allow it to pass through a modern-day photocopier.

8. A high risk of the printed material catching fire as a result of the oven over-heating.

9. Very poor appearance of relief printed matter especially of that carried out on lightweight supports or on supports easily affected by heat.

10. The impossibility of designing more compact machines with the aim of equipping small printworks with little available space.

The totality of these major inconveniences limits the full development of the prior art procedure which otherwise would have considerable potential were it not for the previously described limitations.

From a study of previous patents carried out at our request by the European Patent Office in The Hague (Holland) in relation to thermographic powders, it is clear that none of the documents referred to teaches the present inventive method. None of the references located teaches a method of thermographic relief printing using a thermographic powder which accelerates the formation of a film on the powdered surface, while at the same time preserving and improving the mechanical or thermal properties of the film.

For reference, these documents can be defined as follows:

U.S. Pat. No. 1,966,907, July 17, 1934 deals with an ink intended to give good flexibility and adherence to thermographic film.

U.S. Pat. No. 2,272,706, Mar. 26, 1938 concerns products giving a shiny surface, good appearance which does not peel and which also has good flexibility.

U.S. Pat. No. 2,226,867, Aug. 11, 1939 deals with the production of a matt powder.

U.S. Pat. No. 2,288,860, June 4, 1940 shows powders for flocking the thickness of which can be increased and controlled.

U.S. Pat. No. 2,317,372, Dec. 28, 1940 deals with a high-temperature ink.

U.S. Pat. No. 2,391,705, Aug. 10, 1942 concerns luminescent powders.

U.S. Pat. No. 3,083,116, Mar. 26, 1963 concerns colored powders.

U.S. Pat. No. 3,440,076, Apr. 22, 1969 concerns inks and powders enabling a relief film to be obtained which is hard and resistant to printing on both sides.

U.S. Pat. No. 3,432,328, Mar. 11, 1969 deals with a process based on a resinous ink allowing for relief printing to be obtained from a stencil.

U.S. Pat. No. 4,044,176, Aug. 23, 1977 is concerned with expansible microcapsules.

British patent No. 713073, Feb. 13, 1951 deals with fluorescent products.

British patent No. 741051, July 16, 1953, concerns a procedure for relief printing where the powder is bound by the action of a liquid product.

British patent No. 881243, Feb. 15, 1960, concerns a presentation of the powder in the form of microspheric grains.

British patent No. 905416, May 27, 1960, deals with thermographic powders with metallic pigmentation.

German patent No. 144744, Sept. 12, 1901, relates to powders with an asphalt base for special printing.

German patent No. 576389, May 10, 1933 deals with powders intended to produce a high quality relief film.

German patent No. 804215, July 8, 1949, deals with powders creating decorative effects.

German patent No 1100654, June 24, 1959, concerns the improvement of the surface state of the film.

French patent No. 449451, Oct. 15, 1912 concerns a procedure for obtaining relief printing from powder and steam.

French patent No. 594642, Mar. 6, 1925 relates to a thermographic relief printing procedure using any powder.

French patent No. 813976, Feb. 14, 1936, deals with powder based on products available at the time, without precise specifications or thermographic machine.

European patent No. 0048478, Sept. 23, 1980, shows a powder making it possible to modify the state of the surface and rendering it sticky. A powder is used on photographs or photochemical products.

Japanese patent No. 5537341, Sept. 8, 1978, deals with transparent microspheric powders, which are infusible, for decorating an inked surface.

Japanese patent No. 585285 A, July 3, 1981, concerns a powder which is comestible.

Japanese patent No. 59142680 A, Feb. 5, 1983, deals with a powder in the form of a toner to replace printing ink.

The present invention has as an object to remedy the foregoing deficiencies by facilitating the production of a range of powder products formulated in relation to the end product and the material at the disposition of the printer.

Another object of the invention consists in decreasing by a significant amount the treatment time of the printed material in a ratio of 1 to 3 depending on the type of support, the purpose of the printed material, the subtlety of the motifs, and the nature and the lengths of the ovens used, in such a way as to accelerate proportionally the production of the machines.

Another object of the invention is, while maintaining the production, to decrease considerably the temperature of the tunnel ovens.

Another object of the invention relates to the improvement in energy costs resulting from the use of these powders. To give an example, the transformation into relief of a printed product carried out on a card 320 grams per square meter in weight and of a width of 1200 millimeters, requires a tunnel oven of about 150 Kilowatts. A reduction in its power of 50% means a considerable energy saving. This saving is doubled in the case of air conditioned premises.

Another object of the invention is to diversify the thermal characteristics of the film and in particular to produce products resistant to a slight increase in temperature, to allow the printed matter, for example, to pass through a photocopier set at 150° C.

Another object of the invention is to improve at the same time the physical qualities of the relief film and its thermal qualities.

Another object of the invention is to avoid the thermal degradation of a fragile support either by lowering the maximum temperature of the ovens or by reducing the treatment time.

Another object of the invention is to limit the abrupt dehydration of their fibers of the paper and their partial thermal degradation, in a manner so as to avoid, limit or reduce, a reduction in the size of the support after treatment.

Another object of the invention concerns the improvement of the tension and the quality of the relief film particularly on solid surfaces carried out on light or heavy-weight supports. This improvement brought to the products also results in an important increase in the production of the machines.

Another object of the invention is to decrease the risk of the support catching fire.

Another object of the invention is to permit, thanks to these powders, the construction of more compact machines than those in use at present.

Another object of the invention is on the one hand, to decrease the rise in room temperature due to the present overheating of ovens, particularly in the case of relatively small workshops where working conditions are sometimes hardly bearable and consequently to improve the functioning of the machines.

Another object of the invention is to substantially lower the price of thermographic powders depending on their use.

Another object of the invention is to bring about, by the totality of the improvements achieved, a significant lowering of the product ion cost for relief printing while maintaining or improving its quality.

Another object of the invention is the obtaining of powders of which the grains are preferably microspheric in form. As will be explained, the grains are preferably of different dimensions, in a specific ratio, to obtain the highest filling rate (packing density) possible of the powdered surface. This approach meets a certain number of criteria which can be collectively defined as follows:

a) Film formation accelerated in comparison to that obtained from the same product when crushed. Indeed, an in-depth study of the transformation, by stages, of a crushed powdered surface into a filmogenous surface revealed under a thermal microscope, that, in the first instance, when the support and the film of powder reach the fusion temperature of the latter, the grains separate from each other and curl up on themselves to form a sort of multitude of more or less perfect microspheres. These grains are actually reacting to a well-known physical phenomenon which shows that any molecular grouping free from all outside forces naturally collects itself into its smallest volume and therefore into a spherical form. When the viscosity of the product and its surface tension are sufficiently low, the spreading out and the formation of a raised relief film takes place. This physical phenomenon does not help in the rapid obtaining of a regular and homogeneous relief film. In effect the grains obtained by crushing have jagged, irregular and anarchic shapes which, before the formation of a relief film, during the transformation stage, give an agglomerate of imperfect microspheres of different diameters which, in a later stage of film formation, have difficulty in joining together and in forming a regular film, without craters. This defect obliges the operator to heat the tunnel oven excessively to abnormally lower the viscosity and to attempt to level the film or to slow down the production.

b) Much improved quality of relief film, particularly on level surfaces.

c) Improvement in the definition of the peripheries of the relief image.

Another object of the invention concerns the method for instant cooling of the powder grains as they come out of the pulverizer, so as to profit from the 'memory' of the product to artificially lower the fusion point and in this way the formation time of the relief film. This mode of operating permits, depending on the product, a saving of 0 to 20% on the reheating time of the product and the support. This savings in energy can be added to that produced within the framework of the invention. Also, the manufacture of the microspheres lends itself to the obtaining of grains which set instantly.

It is known that a certain number of properties, including the thermal properties of polymers and in particular of polyamide resins, depend on the degree of crystallinity of the resin. Now the degree of crystallinity is affected by the thermal history of the resin and in particular the manner in which the latter is cooled while it is being formed. Rapid cooling lowers the crystallinity and therefore the fusion point which, by applying this principle of physics to thermographics, makes it possible for the capacity of the powders used to be considerably improved.

Another object of the invention consists in changing the powder distribution hoppers on thermographic machines and replacing them by hoppers allowing the powdering order of the grains to be selected in relation to their decreasing diameter. The improved hopper arrangement also allows sorting and automatic collecting of the powders by compartment.

Another object of the invention is to produce powders which are compatible with each other to enable the user to obtain the best compromise depending on the eventual use of the printed material.

Another object of the invention concerns the thermal properties given to the products to allow them to achieve a rapid recrystallization of the film to prevent the sheets from sticking together, while at the same time decreasing the length of the cooling conveyor.

SUMMARY OF THE INVENTION

In the method of the invention, a substrate, such as a sheet of paper, is first printed by applying printing ink at a printing station. The substrate is then sprinkled with thermographic powder at successive application stations, each application station being provided with an applicator for applying a thermographic powder of predetermined grain size, the grain sizes being selected to achieve the maximum filling rate possible of the printed surface. The substrate is then passed to an oven in which the powder is fused to the substrate. The application stations can be provided as a powder hopper designed with two powder compartments. Each compartment can be provided with a thermographic powder of preselected grain size, the grain size of the powder in the first compartment differing from the grain size of the powder in the second compartment by a predetermined amount to achieve the maximum filling rate possible of the printed surface. A suction nozzle is preferably provided between the first application station and the next successive application station to dust-off the excess powder not held by the printed substrate. A similar nozzle can be provided after the last application station. The excess powder can be recycled to a redistributor which separates the powder into the respective hopper compartments on the basis of grain size.

Preferably, the powders are formed having grains with substantially microspheric form of specified diameter, the diameter of the powder grains at the first application station being greater than the diameter of the powder grains at the next successive application station.

Another feature of the invention concerns the method of formation of the powder granules by rapid cooling, whereby the powder is of lower crystallinity to artificially lower the fusion point of the powder. In the method of forming the powder of the invention, a base resin is first supplied to a fusion vat and melted. The melted resin is then flowed to an atomizer chamber in which the base resin is transformed into microspheric grains. The microspheric grains are rapidly cooled so that the grains set immediately. The temperature in the atomizer chamber is preferably controlled by introducing a cold, fluid medium, such as a supply of liquid air, the liquid air being supplied to the atomizer chamber at a temperature of between about 0° and 5° Centigrade.

BRIEF DESCRIPTION OF THE DRAWINGS

FIG. 5 is a schematic representation of the arrangement of powder grains in powders of the invention as compared to prior art powders.

DETAILED DESCRIPTION OF THE INVENTION

A study based on a comparative testing of the products of the invention, in particular with the help of thermograms obtained by the differential thermal analysis method D.T.A. and experiments carried out on thermographic machines, progressively revealed a certain number of important parameters which affect the totality of the thermal and physical properties of the powders of the invention. This study took into account certain aspects of the chemistry of polymers of interest in relation to the thermographic powders of the invention which can be listed as follows:

1) A polymer can appear in an amorphous state, or, by contrast, a crystalline one.

If it is amorphous, its structure is disordered (the chains often roll up into a ball) and the weak links between chains give it poor mechanical properties. It is, for example, difficult to crush. If it is crystalline, its structure is very ordered, the strength of the links between chains is considerable, and it will be hard, brittle, with a high fusion point.

Figure 4:
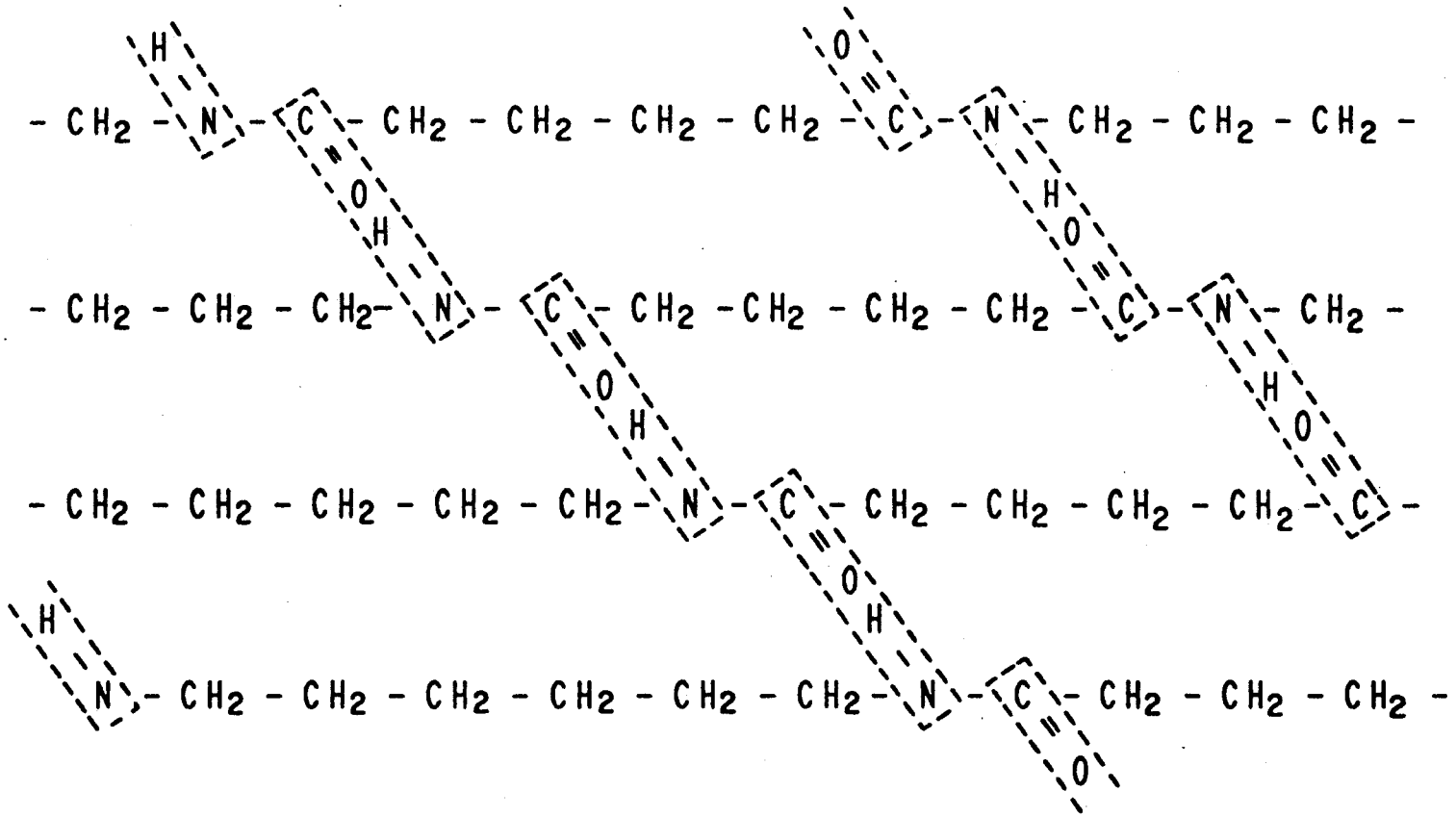
FIG. 4 is a schematic representation of the molecular formula of a base resin used in manufacturing the thermographic powder of the invention.

Neither of these pure states is well adapted to the characteristics required of a thermographic powder. However, polymers often occur in an intermediary state, called semi-crystalline, more in keeping with the intended use in thermographics. As far as polyamides are concerned, they have a tendency to be crystalline, the strength of intermolecular links, the VAN DER WAALS forces, and above all the hydrogenous links between CO and NH of neighboring chains, being very active. This is the case in particular of nylon 6—6, where the ordonancing juxtaposes all the CO and NH links and where the fusion point is higher than 250° Centigrade (FIG. 4).

It is, however, possible to obtain polyamides in a semi-crystalline state more in keeping with the required use. For that to be the case, the frequency of the functional groupings (use of diacids with long chains such as distearic acid and polyethylene diamine) has to be decreased. The functional sites can also be distributed in a more irregular manner (diacids and diamines with different chain lengths). The possibility of modifying the physical properties of synthesized polyamides by the choice of monomers, diacids and diamines to make them especially suited for use in thermographic powders therefore exists.

The same advantages can be obtained, for a polyamide with a given structure and of low molecular mass, which is the case of thermographic powders, by varying the average molecular mass. This variation brings about in particular a lowering of the temperatures of vitrous transition (TG), of fusion and also of the viscosity, when the molecular mass decreases.

The mixture of polymers of the same chemical structure but of different average molecular masses (polymodal distribution of molecular masses) more effectively preserves the specific qualities of each of the polymers than a polymer with a similar total molecular mass but with monomodal distribution. This led us to become interested in mixtures of polymers with different average molecular masses. It can also be seen that low molecular masses tend to introduce swifter softening and as a result speed up the formation of the film. High molecular masses bring suppleness and better thermal behavior to the film of melted powder.

2) Apart from the structure and the chain length of a polymer, its crystallinity also depends on the method used to cool it from its melted state. If the cooling is slow, the chains have the time to form, to organize themselves by favoring interactions between neighboring chains before the system reaches the rigid state and the crystallization is much greater than in the case of rapid cooling, by liquid air for example. In the latter case, the polymer is practically set in the disorder of the melted state, which brings about lower fusion and vitrous transition temperatures than for the slowly cooled compound. We have observed that this result remains valid for polymer mixtures. With appropriate technology, it has resulted in an improvement of the treatment speeds of the elaborated powders.

If a simple chemical body, which is compatible with the polymides but of lower molecular mass, is introduced into the macromolecular network, the former will act as an inflating agent between the neighboring chains of polymers whose polar sites it distances (CO+NH in the case of polyamides) while lowering the strength of the intermolecular links, which has the effect of lowering the fluidification point and the viscosity.

The elements developed below have been verified during the study of the elaborated powders by differential thermal analysis and to a lesser extent by diagrams showing diffraction with X rays. The powders in use at present are polyamide polymers with low molecular weight. The choice of this type of product has been determined naturally by the fact that schematically it unites, by its chemical structures, the characteristics of a wax and a resin. It possesses the shine and the tenacity of a resin. At the same time, like a wax, and depending on its composition, it has to at least a certain extent, the possibility of quickly gathering into a mass a few degrees below its softening point. These characteristics are important in the thermographic procedure where it is useful to shorten as much as possible the setting time, after formation of the film, so as to prevent the sheets from sticking together. The speed at which the film sets determines the length of the cooling conveyor and the power of the cooling attachment which equips it.

Among the powders at present in use throughout the world, the American powder Versamid 1655 or similar powders are used the most and generally speaking give the best result.

The characteristics of the different powders used are the following:

AMERICAN POWDER VERSAMID 1655

Fusion point 110° /125° Centigrade (ball and ring
Viscosity at 160° C. 3 to 4.5 poises

ENGLISH POWDER WOLFF 201-202

Fusion point 112° /118° Centigrade (ball and ring)
Viscosity at 160° C. 4.8 to 5.8 poises

GERMAN POWDER SHERING TP 1648

Fusion point 90° Centigrade (ball and ring)
Viscosity at 160° C. 0.53 poise

These types of polyamides are obtained by the reaction of diacids, monoacids with the amines such as ethylene diamine, diethylene diamine, hexaethylene diamine etc. By varying the proportions and the types of diacids, monoacids and amines, it is known how to obtain resins with very different general characteristics from each other, and the viscosities, hardness, lengthening rates, flexibility of which are variable to a great degree as well as their fusion points of which the minimum is about 70° Centigrade and the maximum 185° Centigrade.

The method of manufacturing thermographic powders of the invention take into account a certain number of parameters of which the main ones are the following:

the temperatures of vitrous transition (TG) "Transition Glass" below which all risk of caking or softening are precluded, must be sufficiently high to allow the product to be stocked and above all ensure that the relief film has a mechanical, thermal or other resistance. A precise adjustment of this parameter is very important depending on the use and the purpose of the printed matter. For the product with a minimum fusion point of 70° C., the TG is about 45° C. For the product with a maximum fusion point of 185° C., the TG is about 145° C.

the viscosity of the product during the formation of the film must be controlled for it not to descend below the threshold where a porous support risks absorbing it. This viscosity is variable from one product to another, depending mainly on the time necessary for the formation of the film. The fact of lowering the viscosity beneath a certain threshold, is not a criteria in the acceleration of film formation. In practice, it is interesting to collectively define by product the 'high' limit at which film formation takes place and the 'low' limit at where the formation time saved becomes negligible and often is of no interest from other points of view. The high limit is preferably about 3.5 to 4.5 poises and the low limit is preferably about 2.0 to 2.5 poises.

the interfacial function of the products vis-a'-vis inked supports must be preserved to give the latter a good dampening quality. The powders actually in use are the polyamide polymers obtained by simple reaction In the present invention, a product is produced from a basic polymer, preferably polyamide, for the reasons given above, the general characteristics of which are adjusted depending on the properties to be given to the final product. The polymer receives a mixture of a certain number of compatible, simple chemical bodies, but of lower molecular masses as well as different adjuvants to give it very specific particular properties. One of the difficulties to overcome in order to produce the invention which is referred to in these claims lies in the fact that very often the totality of the parameters established to reduce a type of product are obtained by combinations with contrasting effects. Therefore it is very important, taking into account that one of the main aims of the patent is to save and to accumulate fractions of seconds during the film formation time and its cooling, to arrive at a precise adjustment of each of the thermal and physical characteristics of each part forming the whole, so as to brings about the best possible compromise. It is in effect relatively easy for somebody in the trade to lower the fusion pint or the viscosity of a polymer. It is however very difficult to preserve or to improve at the same time certain of its physical or thermal characteristics.

The resin must have properties which cannot be arrived at in a product resulting from a single reaction of polymerization. These products can only be obtained by an adequate mixture of resins which each contribute their specific properties. The properties of each of the resins not being strictly cumulative, it is necessary to adjust the properties of the alloyage, then the resulting mixture by varying the proportions of each of the basic resins, the simple chemical bodies and the adjuvants to compensate as much as possible for this non-accumulation.

To understand that these properties cannot be obtained from a single product, it has to be realized that the physical properties of a resin or a mixture of resin are a direct result of its chemical composition. In effect, polymers being very complicated mixtures, the physical properties are average properties, resulting from an average composition. Each resin is obtained by a reaction of the basic constituents. Therefore from the same chemical composition different properties are obtained depending on whether all the basic ingredients of a mixture of resins are made to react together or whether the resins obtained by reaction of their base constituents are mixed. This is the reason for which we use preferably and mainly for products which must unite contrasting properties, the alloyage of several polymers. According to the characteristics required for a product, a single basic polymer can be sufficient. In this case it is often useful to add the adjuvants to adjust, for example, the flexibility and the holding of the product on wet ink.

A group of three formulae are given as an example to judge the range of possibilities of the invention and are intended as illustrative examples only.

a) The performance of Formula 1, very valuable for all traditional commercial uses, in relation to Versamid 1655 is between 180 and 220%.

b) Formula 2 'standard' has good mechanical and thermal behavior and a good surface resistance to depolishing, its tension and holding being excellent. The performance of this product in relation to Versamid 1655 is between 150 and 170%.

c) Formula 3 gives instant, strong thermal and mechanical resistance, particularly designed for printed matter intended for passing through a photocopier with its pressure rollers set at 150° C. With this product, which has a very high fusion point, the performance in relation to Versamid 1655 which does not offer these same possibilities, is depending on the support and the type of oven, between 50 and 70%.

Figure 1:
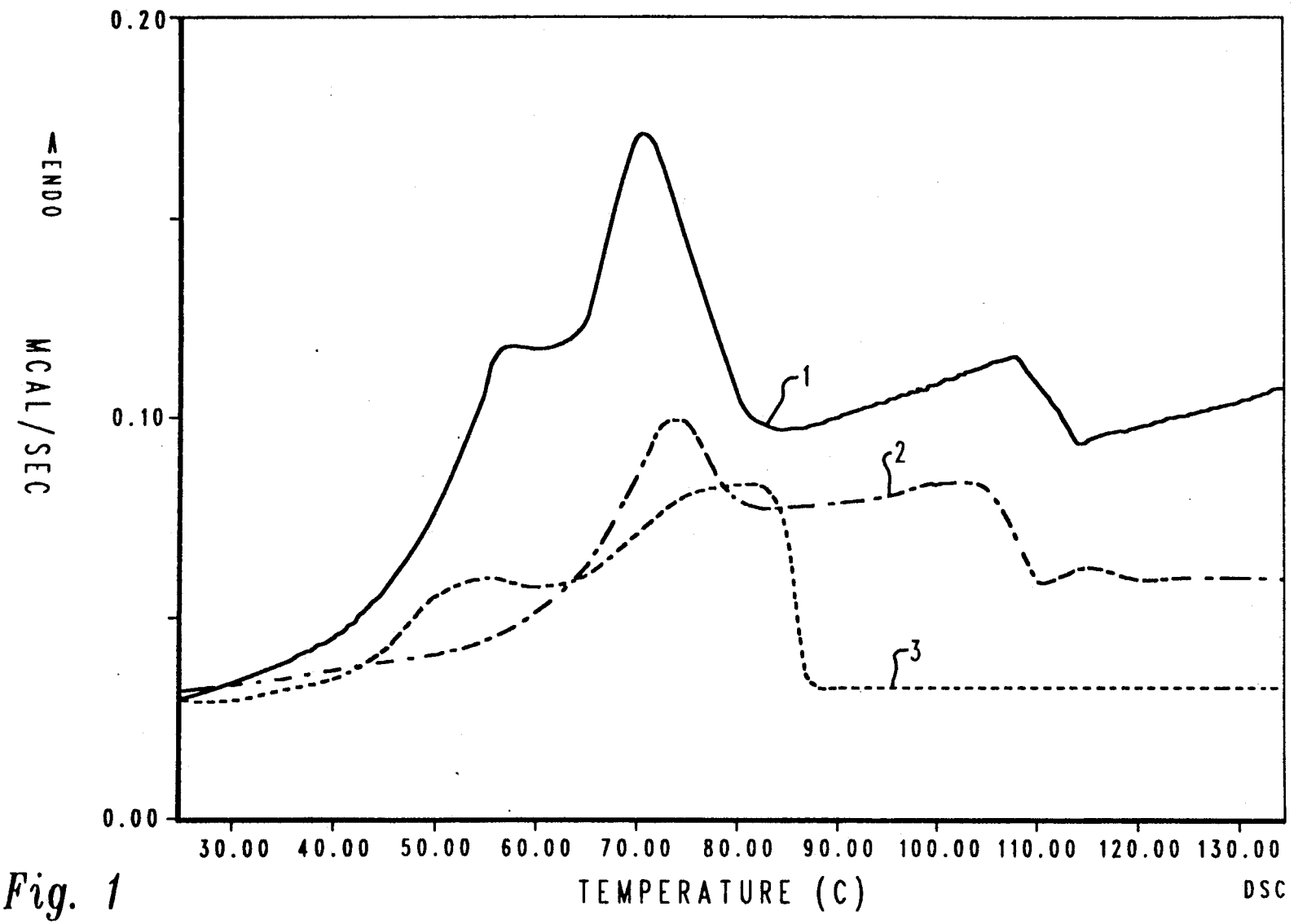
FIG. 1 is a thermograph obtained by differential thermal analysis of the thermographic powder of the invention as compared to prior art powders.
Figure 2:
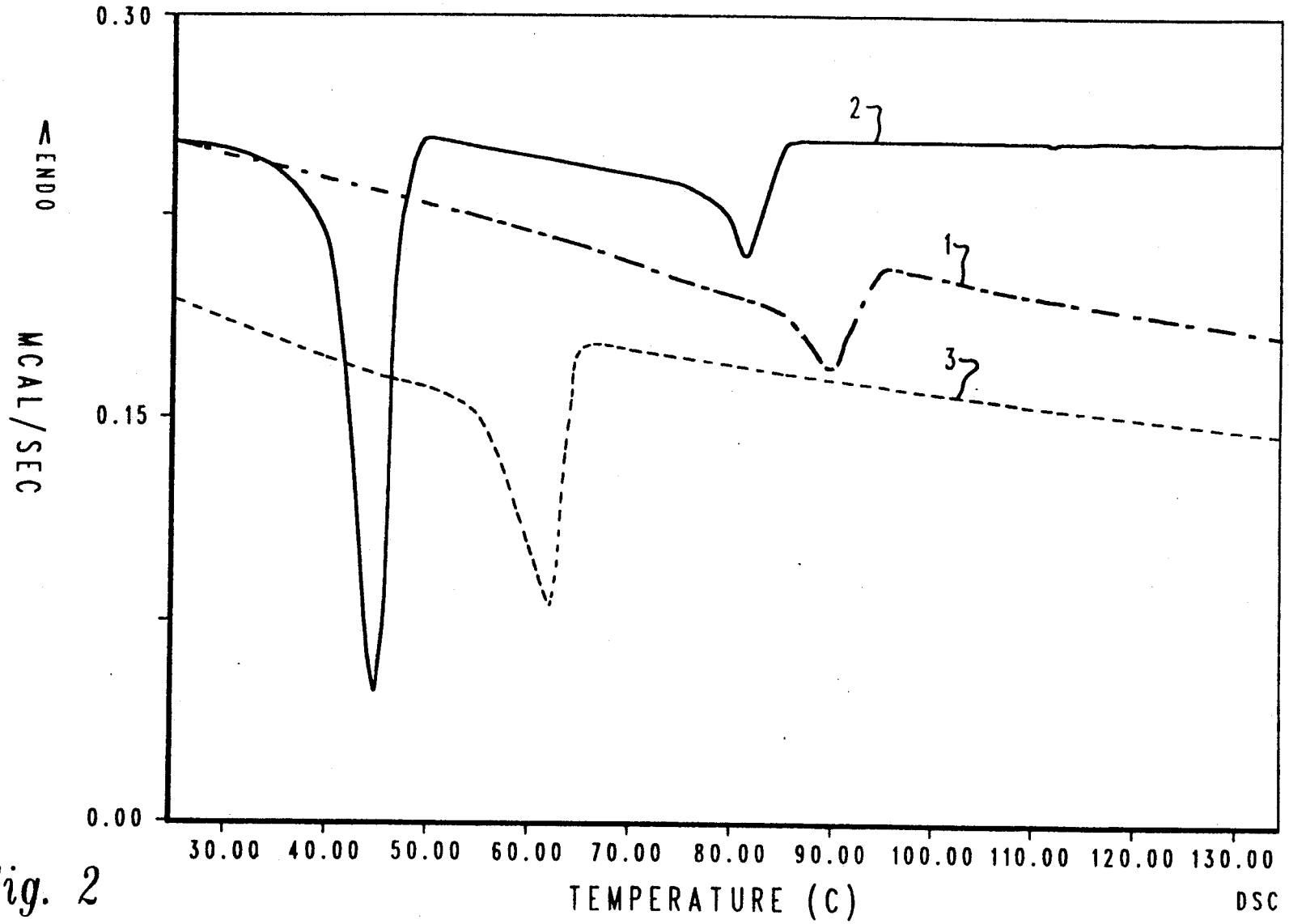
FIG. 2 is a thermograph similar to FIG. 1, showing the cooling curves of the powders after fusion.
Figure 3:
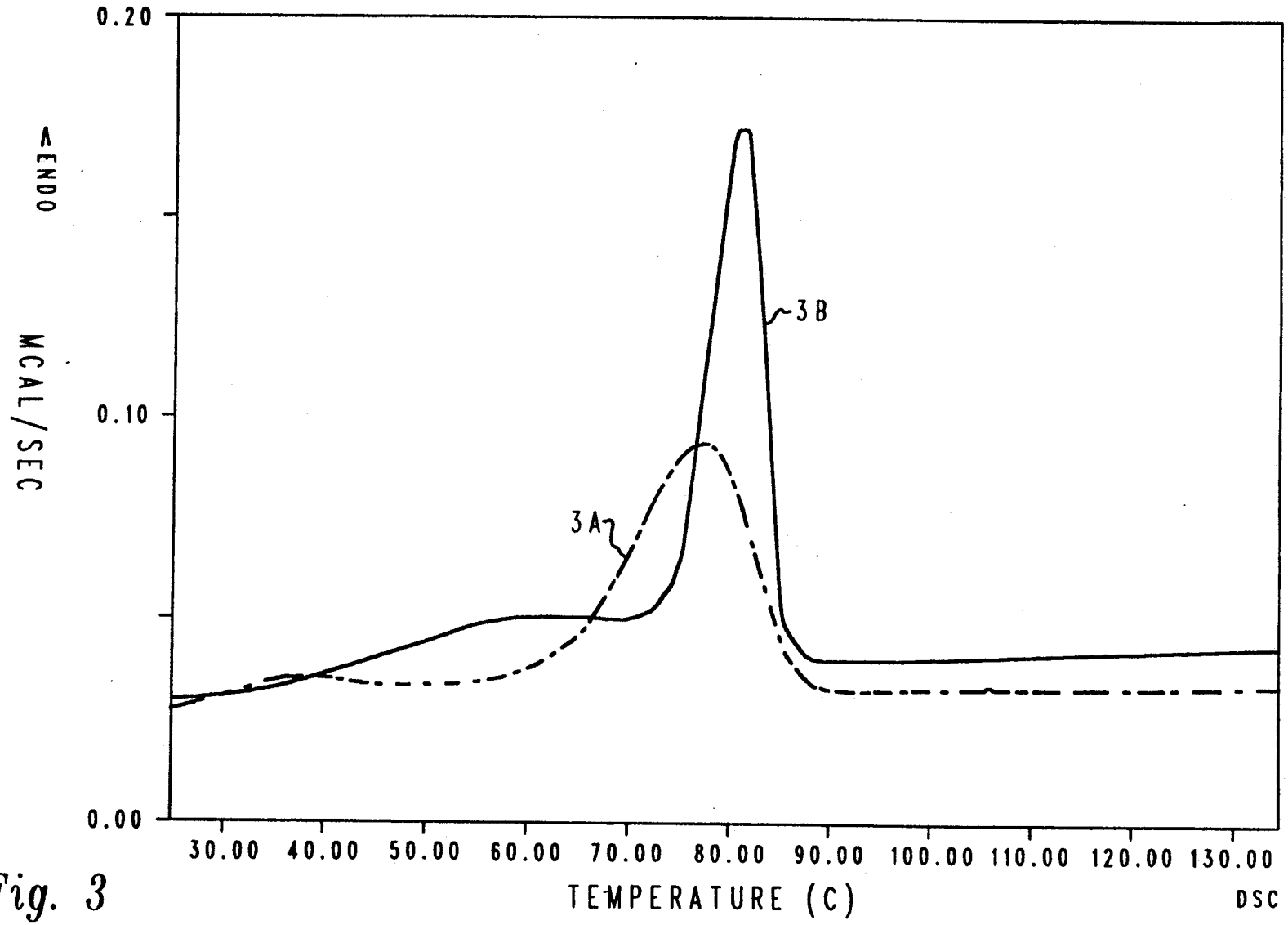
FIG. 3 is a thermograph similar to FIG. 1, comparing a thermographic powder of the invention with a prior art powder.

The FIGS. 1, 2 and 3 represent three thermograms obtained by differential thermal analysis in relation to the Versamid 1655 powders, Shering TP 1604 and the Formula 1 given by way of an example, showing comparatively the thermal characteristics of the different products.

The curves of differential thermal analysis (D.T.A.) are explained in more detail by referring to the appended drawings.

When the temperature of the powder is raised, one or several changes in its physical state can be observed which lead to a progressive lowering of the viscosity and permit the cloaking by the powder of the printed motifs, even before total fusion of the powder.

Finally on cooling, a zone of over fusion beneath which the polymer film will be solidified and easy to manipulate without risk can be observed. On these curves, the first curvature of the base line corresponds to Transition Glass (TG). The last peak corresponds to the total fusion of the powder. Between these two points, the curve shows a certain number of peaks, more or less spread out, and which relate to the crystallinity of the polymer, its mode of distribution, its degree of purity and the existence of mixtures. For example, a polymer which is crystallized gives a single peak in the zone of its TG fusion point. A less organized compound gives several peaks between TG and TF. The impurities or the mixture of ingredients, increases the number of peaks by flattening them. A displacement of the values of the temperatures observed notably of TG and TF can also be observed in this case. It appears in practice that, for the powders showing neighboring fusion points, the powders giving a spread thermogram have shorter spreading times. This results in particular from the fact that the formation process of the relief film can be decomposed into two periods. At first, the viscosity of the powder is lowered. Then the process of coating the printed motifs which requires a minimum time can begin.

For a crystalline product, the lowering of the viscosity is brutal, but occurs only at a later stage, near the fusion temperature, in this way slowing down the beginning of the spreading phase. Whereas for a product of the same nature which is more amorphous, the lowering of viscosity begins at much lower temperatures, therefore more rapidly. It can be seen, in this case, that the formation of the film also take place more rapidly. These behavior patterns are illustrated by the three examples of thermograms described below: The thermogram FIG. 1 treats comparatively the three products which can be defined as follows:

The product 1 represents on the curves the American powder Versamid 1655.

The product 2 represents the powder Formula 1 given by way of an example to define the invention.

The product 3 represents the German powder Shering TP 1648.

In comparison to the two other products, the curve of the Formula 1 shows a displacement of the principal peaks of thermal absorption towards temperatures which are slightly lower, 70° Centigrade instead of 74.8° Centigrade for Versamid 1655, total fusion taking place at respectively 110° Centigrade instead of 115° Centigrade. These differences in temperature are slight, and, at the same time as doubling the total production, allow the good general characteristics of the product to be preserved.

It can be seen on analyzing the curves, that in an identical time, the calorie absorption of the product Formula 1 has been almost double in comparison to Versamid 1655.

It has to be remembered that the calories absorbed by the powders and in the case of a continuous increase in the temperature of the environment, serve on the one hand to increase in a regular manner the temperature of the material, on the other hand and at certain specific temperatures to furnish the necessary energy for an endothermic reaction. The supplementary transfer of energy is shown on the thermogram, by a peak or an endothermic deformation of the base line. This reaction corresponds to a change in the physical state which is shown in the present case by a lowering of viscosity, then finally by the complete fusion of the grains.

It can also be noted that the peaks are in general wider, which indicates that the endothermic reaction take place in a much more brutal manner and begin at an appreciably lower temperature.

The cooling curves of the powders, after fusion, FIG. 2, also show that in the case of the mixture 1, the solidification peak takes place at a temperature a little lower (80 ° instead of 88°) to that noted for the Versamid 1655 1 powder. The solidification, during cooling, after the film formation of this powder 1, takes place however within a shorter time when it is considered that the temperature reached during the spreading of the powder is lower for 2 than for 1.

FIG. 3 concerned with the Shering TP 1648 product, with a structure to that of the other products. It differentiates itself by a thermogram characterized by a considerable peak in the fusion zone, which indicates a more elaborate crystalline structure than the other products. This new product is a good illustration of the aim of the invention, for it shows that contrary to the commonly acknowledged fact, it is not sufficient to lower the fusion point (−25°) of a product and to diminish (by 5/6ths) its viscosity in order to obtain a better thermographic performance. In the present case, the speed of film formation is clearly inferior to the other products and its mechanical resistance is also not as good. This confirms the techniques of the present invention which tend to decrease the crystallinity of the powders to allow for a much greater calorie absorption of the product at a given temperature, causing a much quicker film formation. In the same way, during the cooling of the melted Shering TP 1604 powder, the over fusion is much more important than for the other powders and the solidification only appears at about 45 ° C., implying a longer cooling time, so that the printed sheets do not stick together.

The thermograms of FIG. 3A and 3B also show that is is possible to lower the crystallinity of a polymer by a rapid lowering of the temperature after fusion. In the case of rapid cooling FIG. 3A, it can be seen in relation to a slow cooling FIG. 3B, that there is a widening of the peak and it is displaced towards the low temperatures. This rapid cooling technique can be used for all the mixtures with a polymer base and also leads to materials which are less crystalline, showing a faster film formation profile. This technique is well adapted to the production of powder with microspheric grains which can be brutally cooled. The time saved artificially by this manner of proceeding can be added to the other savings obtained by the thermal properties given to the product. The English patent A 881.243 (Leslie Charles Ward) relates to a thermographic powder with a microspheric form. The method as described in this patent has serious failings which are corrected by the means used in the present invention. These microspheres are obtained by pulverization and have very regular diameters defined by the viscosity of the product in its melted state, and the rotation speed of the atomizer disk FIG. 7 23, or by the pressure of the pulverization nozzle. This characteristic holds a serious inconvenience for the thermographic procedure, where it is indispensable in order to obtain a maximum filling rate by the grains of the powdered surface, to vary in well specified proportions and diameters, the powder grains covering it. As is shown schematically in FIGS. 5A, 5B and 5C, the distribution of the microspheres is quite anarchic and there is the risk of considerable spaces being left leading mainly, for the microspheres of 150 to 300 microns, used on solid surfaces, to gaps which are impossible to fill properly and which result in a surface appearance with craters which are incompatible with the aim of the procedure which is to bring a decorative effect to the printing. The end result is not as good as with powders obtained by crushing (FIG. 5D).

In the the case of a mixture of microspheric grains with a variable diameter (FIG. 5H), the result is more or less comparable to that obtained with crushed grains (FIG. 5D) and is sometimes even less satisfactory. The solution used in the framework of the invention consists of carrying out two successive powderings of the printed matter, the first 13A in FIG. 6 with grains of a basic diameter, determined in accordance with the thickness of the relief film selected, the second powdering 13B in FIG. 6 with grains of a specific diameter to fill, as well as possible, the gaps left by an anarchic distribution of powder (FIGS. 5A, 5B and 5C). This manner of proceeding gives the best result. The powder grains are preferably of different dimensions, in the specific ratio, to obtain the highest filling rate possible of the powdered surface. For example, if the average diameter of the powder grains used in the first powdering is approximately 150 microns, then the average diameter of the powder grains used in the second powdering should be approximately 60 microns. This is a ratio of approximately 15 to 85.

Figure 6:
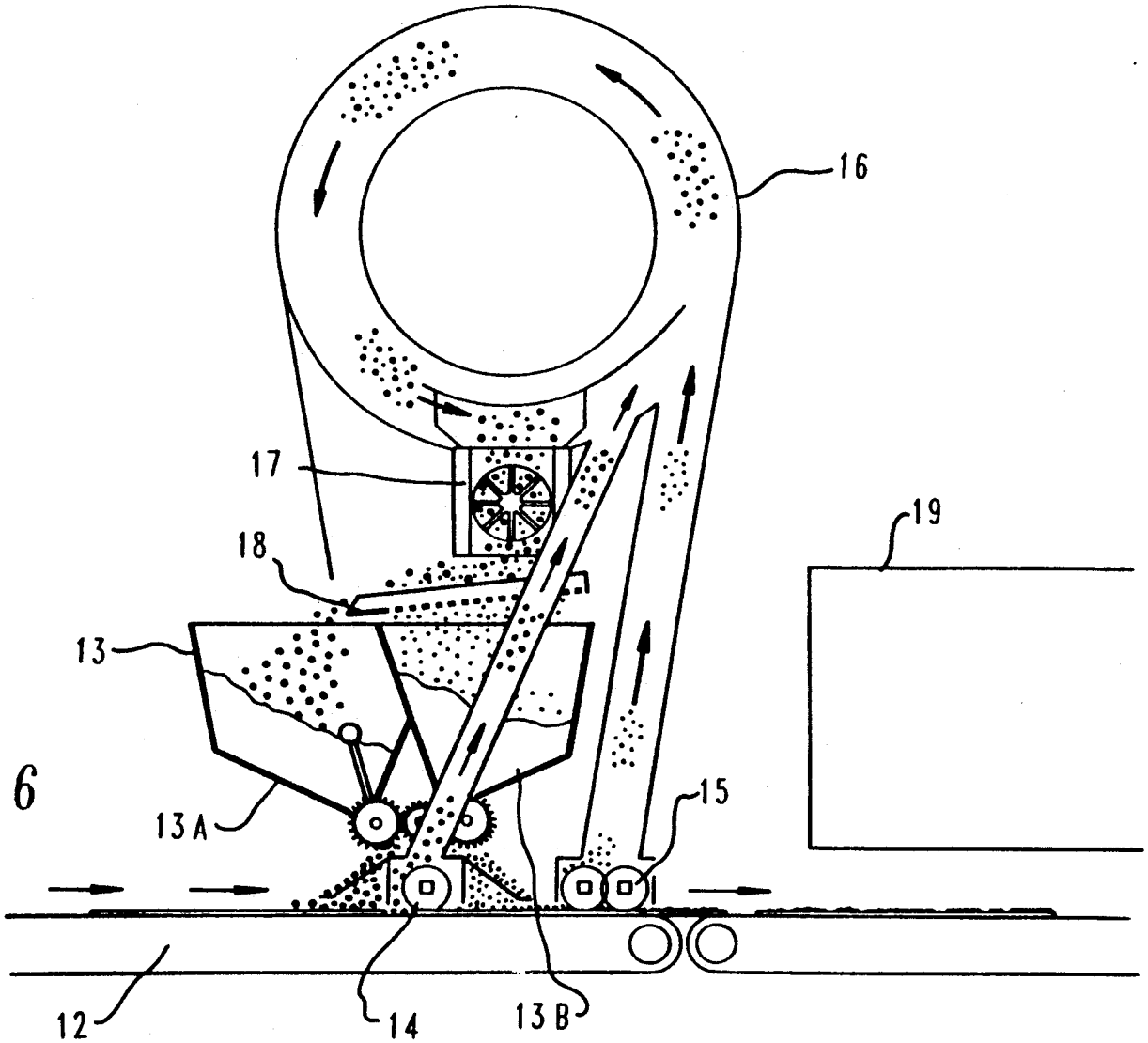
FIG. 6 is a simplified schematic illustrating the method of applying a thermographic powder of the invention.

The double powdering of the printed matter is carried out by modifying the distribution and recycling systems of the powder on the thermographic machines. The FIG. 6 shows a traditional powder block on which the hopper which holds the powder has been replaced by a hopper 13 with two compartments 13A and 13B and is linked to a complimentary suction nozzle 14 which dusts off the first covering of powder before going on to the second. This is simpler and less complicated than equipping the machines with two successive powdering blocks and the result is the same. The functioning of these powder blocks is described below schematically, with reference to the appended drawings.

A feed conveyor 12 FIG. 6 receives the printed material from the printing press and brings it successively under the hopper 13 where it receives the first powdering from the first compartment 13A, then under the dusting-off nozzle annex 14 which recuperates the excess of grains not held by the ink and recycles them by the intermediary of cyclone 16. The printed matter then passes under the second compartment 13B of the hopper 13 where it receives the finer powder and finally under the principal final dusting-off nozzle 15, with a double row of disks, the most efficient, from where the printed material comes out correctly dusted off outside the printing zone. The cyclone 16 sucks up the powders from the two suction nozzles 14 and 15 and recycles them to the redistributor 17 which drops them above a vibrating sieve 18 equipped with holes which only allow the fine grains to pass through and fall back into the compartment 13B of the hopper 13. The large grains, at the end of the vibrating sieve 18 fall into the compartment 13B. The powdered printed matter then passes inside the tunnel oven 19. The microspheres forming the powder can be obtained in different ways, either by direct pulverization of the product in its liquid state as it comes out of the mixer by the established method of the atomizer tower FIG. 7 frequently used in the obtaining of chemical products in powder form or directly during the manufacturing of the product by agitation and chemical precipitation.

By way of example a preferred method for production of the invention is described with reference to the appended drawings.

Figure 7:
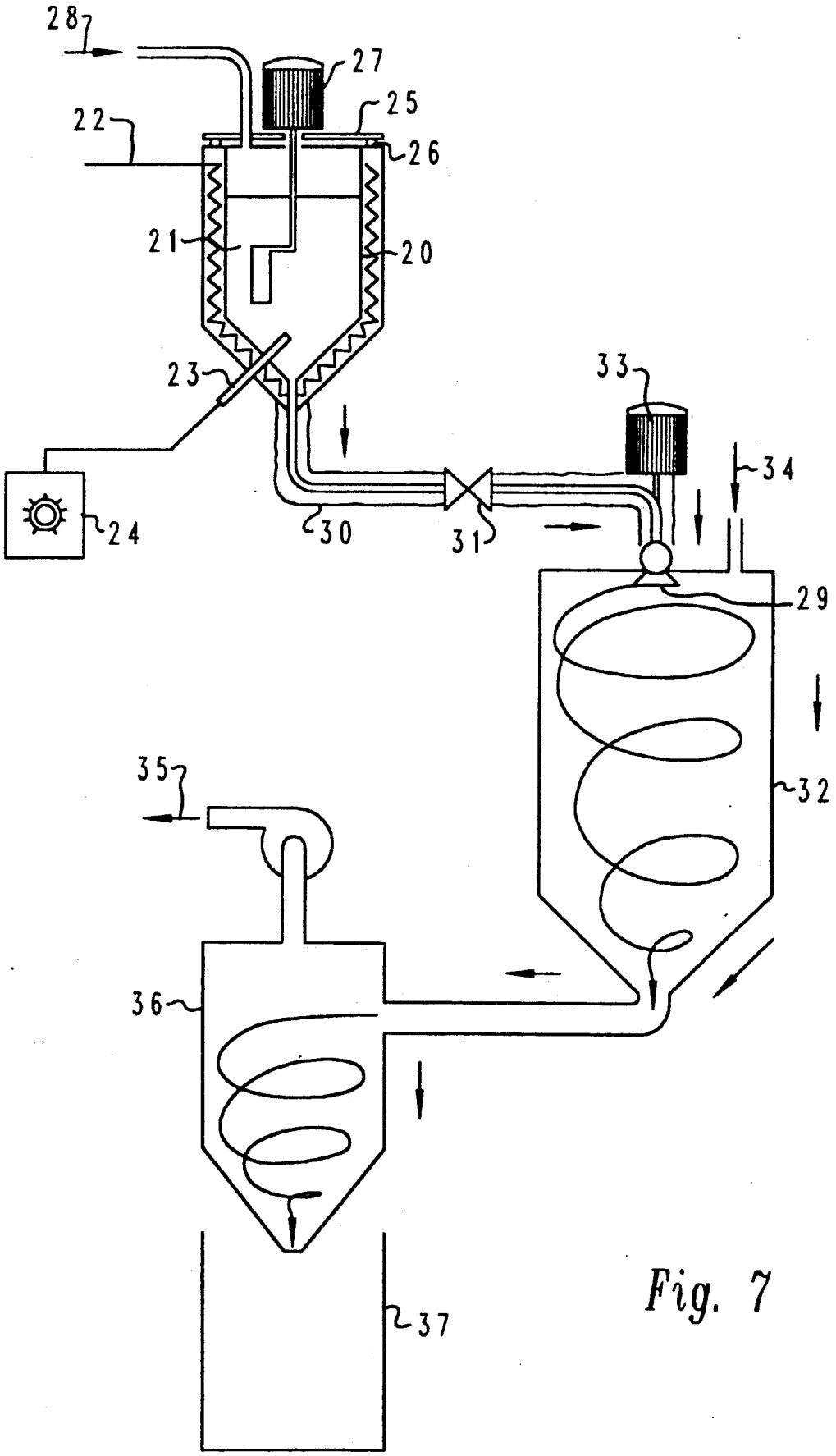
FIG. 7 is a simplified schematic illustrating the method of manufacturing the thermographic powders of the invention.

FIG. 7 shows an atomizer tower of classical design, shown schematically for it to be understood. A fusion vat 20 which can be replaced by the mixer itself, contains the base resin 21 to be atomized which is heated with the help of elements 22 (or any other method) its interior temperature being read by a probe linked to a thermal regulator 24. The vat consists of a cover 25 equipped with an air-tight joint 26 and an agitating mixer 27. A supply of nitrogen 28 under slight pressure (about 2 bars) has the double purpose of preventing the oxidization of the product and of pushing it up to the atomizer disk 29. A hose sheathed with heating tape 30 carries the product, the flow being regulated, through a gate to the atomizer disk 29. An atomizer vat 32 about two meters in diameter, holds the atomizer disk 29 the diameter of which is 210 millimeters. Its rotation speed of 15,000 r.p.m. is obtained by aid of a step-up motor 33. Its peripheral speed is about 165 meters per second for a flow of powder with microspheric grains of about 135 kilograms an hour. The product having been pushed through the atomizer disk 29 is ejected by centrifugal force and the microspheres are formed immediately by the same physical phenomenon as that noted during formation of the relief film on the printed matter. The diameter of the microspheres from 30 to 500 microns is controlled by adjusting the viscosity of the product by varying its temperature. In order to achieve the rapid cooling of the product to form powder grains which are less crystalline, a supply of cool air 34 maintains the interior temperature of the atomizer tower at a temperature of between 0° and 5° Centigrade. The grains formed set immediately, and drop towards the bottom of the vat. By "immediately", we mean that the time period between the product exiting the atomizer disk as a liquid particle and the time at which a hard microsphere is formed is approximately ¼ second. The powder grains thus formed are sucked by an aspirator 35 through a cyclone separator 36. A reception trough 37 completes this apparatus. The principle of pulverization by atomizer disk has been used because of the simplicity of its setting up and the small amount of pressure that it requires for atomizing the product.

Other methods more or less identical are used to reach a similar result, where the atomizer disk is replaced by a nozzle through which the product is injected under pressure.

To properly understand the individual function of each of the constituent parts in relation to the formulae given by way of an example (although not an exclusive one), the role of each constituent is described after each formula.

| Formula 1: Alloyage of three polyamide polymers | | |
|---|---|---|
| 1 | Polyamide resin Versamid 1655 | 27% |
| 2 | Hard polyamide resin | 13% |
| 3 | Supple polyamide resin, tough with a elongation rate | 11% |
| 4 | Stearilamid wax 80 | 15% |
| 5 | Stearilamid wax 140 | 7% |
| 6 | Hydrogenized tallow | 12% |
| 7 | Pure hydrogenized soya | 11% |
| 8 | Acetanilid | 0.5% |
| 9 | Trimethylol propane | 0.3% |
| 10 | Triphenyl phospate | 0.3% |
| 11 | Fatty amid acid | 0.1 to 0.3% |
| 12 | Plasticizer | 2% |
| 13 | Antistatic | 2% |
| Optional | | |
| 14 | Antioxidant | 0.05% |
| 15 | Optical blue | 0.05% |

1 Polyamide resin Versamid 1655 fusion point 110°–125° Centigrade (ball and ring)
viscosity at 160° Centigrade 3 to 4.5 poises gives on the whole interesting general characteristics because of the length of its chain.

2 Hard polyamide resin fusion point 108° Centigrade (ball and ring)
viscosity at 160° Centigrade 18 poises
gives to the alloyage and to the finished product mechanical characteristics.

3 Supply polyamide resin fusion point 114° Centigrade (ball and ring)
viscosity at 160° Centigrade 92 poises
elongation 450%
gives the final product suppleness, a horn-like quality, mechanical resistance and above all prevents, even in a hyperfusible formula, too great a drop in viscosity causing the absorption of the film by the porous support.

4 Stearilamid wax 80 fusion point 80° Centigrade (ball and ring)
improves the thermal properties and the depolishing of the surface.

5 Stearilamid wax 140 fusion point 140° Centigrade (ball and ring)
gives the same properties as 4 and as well permits the fusion point to be adjusted and improves the hardness and the slipperiness of the film.

6 Hydrogenized tallow improves the thermal properties and gives good compatibility with printing inks and aids in giving a better holding quality to the film.

7 Pure hydrogenized soya improves the thermal characteristics and helps to control the viscosity of the product.

8 Acetanilid considerably lightens the color of the product and fluidifies it.

9 Trimethilol propane accelerates film formation.

10 Triphenol phosphate accelerates film formation and makes it more supple.

11 Fatty amid acid comes to the surface during film formation and gives it a slippery quality to prevent depolishing.

12 Plasticizer made from sulfonamid it brings suppleness and a good holding quality of the film on the ink.

13 Cationic type antistatic gives conducting quality to prevent static electricity.

14 Traditional antioxydant

15 Classic optical blue improves the transparency of the film.

The products 7, 8, 9, and 10 have a relative compatibility with the base resin and give, during the fusion of the film, good molecular mobility which tends to accelerate the process of formation.

The total of the adjuvants added to the alloyage of the base resins is appreciably three times cheaper than these latter which reduces to a considerable extent the production cost of the final product. The very light color which the adjuvants give to the whole also reduces the price of the base resins by starting, in their manufacture, with fatty diacids which are more colored. Because of this, their price is lower by more than 40%. For certain products intended, for example for cardboard, the incorporation in the base resins of 30 to 40% of synthesis of rosin also decreases their price.

| Formula 2: Alloyage of two polyamide polymers | |
|---|---|
| 1. Hard polyamide resin | 28% |
| 2. Supple polyamide resin | 18% |
| 3. Stearilamid wax 80 | 16% |
| 4. Stearilamid wax 140 | 12% |
| 5. Hydrogenized tallow | 8% |
| 6. Pure hydrogenized soya | 7% |
| 7. Stearone (diheptadicylketone) 88° | 8.5% |
| 8. Acetanilid | 0.3% |
| 9. Trimethylol propane | 0.3% |
| 10. Triphenol phosphate | 0.3% |
| 11. Fatty amid acid | 0.10% |
| 12. Plasticizer | 0.5 to 1% |
| 13. Antistatic | 1 to 2% |

With the exception of the proportions and the diheptadicylketone with a fusion point of 88° Centigrade which acts as a thermal regulator and fluidifier of the whole, the other ingredients are the same.

| Formula 3: A single polyamide polymer | |
|---|---|
| 1. Polyamide resin 185° | 64% |
| Viscosity at 160° C. | 22 poises |
| 2. Stearilamid wax 140 | 18% |
| 3. Trimethylol propane | 1% |
| 4. Phenacetin 137° | 6% |
| 5. Phenacetamid 158° | 10% |
| 6. Antistatic | 1% |

The polyamide resin used in this formula has practically the highest fusion point, 185°, which it is reasonably possible to obtain in this type of product. The other products are intended to lower the viscosity and to allow it, in a sufficiently short time to prevent the printed matter from being burned, to be filmogenous, without being obliged to overheat it.

I claim:

1. A thermographic relief printing method comprising the steps of:

printing a substrate at a printing station;

sequentially sprinkling the printed substrate with thermographic powder at a first and second application stations, each of the first and second application stations being provided with an applicator for applying a thermographic powder of predetermined grain size, the grain sizes being selected to achieve the maximum packing density possible of the printed surface, the powders being formed with substantially microspheric form of specified diameter, the diameter of the powder grains at the first application station being greater than the diameter of the powder grains at the second application station; and passing the substrate to an oven in which the powder is fused to the printed areas of the substrate.

2. A thermographic relief printing method for relief printing of paper substrates, comprising the steps of:

printing a paper substrate at a printing station;

sequentially sprinkling the printed substrate with thermographic powder by moving the substrate past a hopper having first and second compartments, each of the first and second compartments being provided with a thermographic powder of preselected grain size, the grain size of the powder in the first compartment differing from the grain size of the powder in the second compartment by a predetermined amount to achieve the maximum packing density possible of the printed surface, the powders being formed with substantially microspheric form of specified diameter, the diameter of the powder grains at the first compartment being greater than the diameter of the powder grains at the second compartment; and passing the substrate to an oven in which the powder is fused to the printed areas of the substrate.

3. The method of claim 2, further comprising the steps of:

providing a suction nozzle between the first compartment and the second compartment to dust-off the excess powder not held by the printed substrate;

providing a similar suction nozzle after the second compartment; and recycling the excess powder to a redistributor which separates the powder into the respective hopper compartments on the basis of grain size.

* * * * *